US005894764A

United States Patent [19]

Hanlon

[11] Patent Number: 5,894,764

[45] Date of Patent: Apr. 20, 1999

[54] HAMMER WITH NAIL-HOLDING STRUCTURE

[76] Inventor: Dennis Hanlon, 15 Morris Rd., East Haven, Conn. 06513

[21] Appl. No.: 08/892,261

[22] Filed: Jul. 11, 1997

[51] Int. Cl.[6] ..... B25D 1/00

[52] U.S. Cl. ..... 81/23

[58] Field of Search ..... 81/23, 425, 24

[56] References Cited

U.S. PATENT DOCUMENTS

| | | | |
|---|---|---|---|
| 82,621 | 9/1868 | Hubbard . | |
| 115,008 | 6/1871 | Young . | |
| 116,553 | 7/1871 | Cheney . | |
| 299,213 | 1/1884 | Puntillo . | |
| 303,208 | 9/1989 | Chung . | |
| 308,007 | 5/1884 | Ferguson et al. . | |
| 450,011 | 4/1891 | Hackett | 81/23 |
| 509,399 | 11/1893 | Richardson . | |
| 745,973 | 12/1903 | Starrett . | |
| 937,987 | 10/1909 | Carlson . | |
| 976,679 | 11/1910 | Morrison . | |
| 1,137,663 | 4/1915 | Renton . | |
| 1,209,583 | 12/1916 | Holmdahl . | |
| 1,258,053 | 3/1918 | Starrett . | |
| 1,664,594 | 3/1928 | Cummings . | |
| 2,597,876 | 5/1952 | Kurkjian . | |
| 3,543,821 | 12/1970 | Johnson . | |
| 3,788,373 | 1/1974 | Aherin | 145/30 |
| 3,987,828 | 10/1976 | Matheis | 145/30 |
| 4,193,433 | 3/1980 | Sickler . | |
| 4,270,587 | 6/1981 | Ludy . | |
| 4,273,172 | 6/1981 | Hoosier . | |
| 4,367,778 | 1/1983 | Bradbury . | |
| 4,448,230 | 5/1984 | Reed | 145/30 |
| 4,465,115 | 8/1984 | Palomera . | |
| 4,658,679 | 4/1987 | Nitzberg et al. . | |
| 4,667,747 | 5/1987 | Falls et al. . | |
| 4,718,313 | 1/1988 | Yamaguchi | 81/23 |
| 5,000,064 | 3/1991 | McMahon . | |
| 5,213,023 | 5/1993 | Floyd . | |

FOREIGN PATENT DOCUMENTS

| | | | |
|---|---|---|---|
| 552630 | 9/1958 | Italy | 81/23 |

OTHER PUBLICATIONS

Abstract from U.S. Patent No. 4,448,230, Issued May 15, 1984, By Reed.

*Primary Examiner*—David A. Scherbel
*Assistant Examiner*—Dung Van Nguyen
*Attorney, Agent, or Firm*—Bachman & Lapointe, P.C.

[57] ABSTRACT

A nail holding hammer includes a hammer head having a forward nail striking surface; and a nail holding structure for releasably holding a nail having a point, a head and a body portion therebetween wherein the nail holding structure holds the nail with the point facing forward, the nail holding structure including a notch for receiving the body portion and a striking anvil for contacting the head with the body portion in the notch.

14 Claims, 3 Drawing Sheets

HAMMER WITH NAIL-HOLDING STRUCTURE

CROSS-REFERENCE TO PATENT OFFICE DISCLOSURE DOCUMENT

This application is related to disclosure document No. 412,663 filed Feb. 10, 1997 at the U.S. Patent Office. It is respectfully requested that this disclosure document be transferred to the file of the present application.

BACKGROUND OF THE INVENTION

The invention relates to hammers, and more specifically to a hammer having structure for releasably holding a nail in a forward-oriented position to assist in starting a nail.

Most carpenters have experienced injury to fingers or thumbs caused by missing a nail while holding the nail to initially drive or start the nail into the desired material.

Furthermore, hammering or driving nails while in difficult positions, such as perched on a ladder, can be even more difficult when both hands are needed, one to hold a nail and the other to hold the hammer. As can be attested to by many in the field, this is a long-standing problem which needs a solution.

A large number of attempts have been made to provide a solution to this problem. A number of patents disclose various structures for holding a nail on the hammer for making the initial impact with the material in which the nail is to be driven so as to start the nail with a swing of the hammer and without needing the nail to be held in place. These disclosures are characterized, however, by a number of disadvantages. These disadvantages include structure which interferes with or detracts from the striking surface of the hammer, structure which includes magnets having a tendency to de-magnetize, structure which requires awkward movement to insert and release nails, and the lack of a good striking anvil for making the initial drive of the nail.

Thus, the need clearly remains for a hammer including a nail-holding attachment which overcomes the aforesaid disadvantages.

It is therefore the primary object of the present invention to provide a hammer having a nail-holding attachment which does not interfere with the striking surface or head of the hammer.

It is a further object of the present invention to provide such an apparatus wherein the nail-holding attachment mechanically holds the nail, without the need for a magnet, and which firmly holds the nail in place in a position wherein the nail is easily placed in the attachment, and released through a smooth and ergonometric motion after the nail has been started.

It is still another object of the present invention to provide an apparatus as described wherein the attachment has a good striking anvil for the nail.

Other objects and advantages of the invention will appear hereinbelow.

SUMMARY OF THE INVENTION

In accordance with the present invention, the foregoing objects and advantages are readily attained.

In accordance with the invention, a hammer is provided having a nail-holding structure, which comprises a hammer head having a forward nail striking surface; and means for releasably holding a nail having a point, a head and a body portion therebetween, wherein said means for releasably holding holds said nail with said point facing forward, said means for holding comprising a notch for receiving said body portion and a striking anvil for contacting said head with said body portion in said notch.

In further accordance with the invention, the means for releasably holding is preferably an integral portion of the hammer head.

In accordance with another aspect of the present invention, the nail-holding hammer which is provided comprises a hammer head having a forward nail striking surface; and means for releasably holding a nail in an engaged position wherein said nail is engaged against longitudinal movement, wherein said means for releasably holding receives a nail in said engaged position through upward pivot of a head of said nail relative to a point of said nail, and said nail is released from said engaged position through downward pivot of said head relative to said point.

BRIEF DESCRIPTION OF THE DRAWINGS

A detailed description of preferred embodiments of the present invention follows, with reference to the attached drawings, wherein.

DETAILED DESCRIPTION

The invention relates to a hammer having a nail-holding structure whereby a nail can be readily and easily engaged to the head of the hammer for driving or starting the nail without requiring the nail to be held in place by the user of the hammer.

Figure 1:
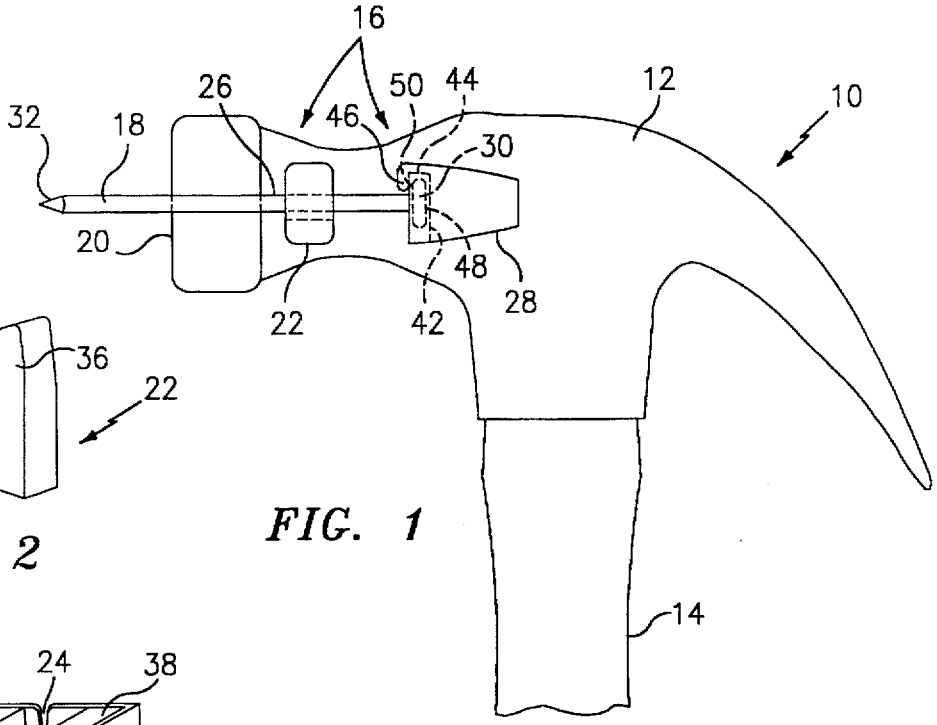
FIG. 1 is a side view of a hammer including a nail-holding structure in accordance with the invention.

Referring to FIG. 1, a hammer including a nail-holding structure in accordance with the present invention is generally referred to by reference numeral 10. As shown, hammer 10 includes hammer head 12, a handle 14 depending downwardly therefrom, and structure 16 for holding a nail 18 oriented facing forward for starting with a single-handed and routine swing of hammer 10.

As shown, hammer head 12 has a striking surface 20 for striking nails to be hammered into a surface as is well known in the art. Hammer head 12 may suitably have any desired shape or structure, and may be typical claw hammer as shown in FIG. 1, for example, or any other type of hammer having different shape or other features as desired.

Nail-holding structure 16 preferably includes a notch structure 22 (see also FIG. 2) which includes a substantially upwardly opening groove 24 for receiving a body portion 26 of nail 18. Structure 16 in accordance with the invention also includes a striking anvil portion 28 against which a head 30 of nail 18 rests or abuts when nail 18 is held by nail-holding structure 16. As shown in FIG. 1, a nail 18 held or engaged within nail-holding structure 16 is arranged with a point 32 oriented facing forward, in the same direction as striking surface 20, such that a nail held within nail-holding structure 16 can advantageously be started with the same motion or swing of hammer 10 as is used during subsequent hammering with the nail already partially driven into the desired surface or structure.

Figure 2:
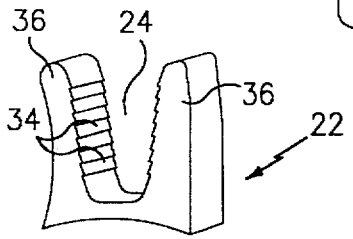
FIG. 2 shows a perspective view of a portion of the nail-holding structure of FIG. 1.

Referring to FIG. 2, additional detail of notch structure 22 in accordance with the present invention is illustrated. As shown, in one embodiment, notch structure 22 preferably includes groove 24 formed having a series of ramps 34 positioned on arms 36 which define groove 24. Also, as shown, arms 36 preferably extend gradually further away from each other so as to define a groove having an upwardly increasing width as shown. This advantageously allows groove 24 to receive nails 18 of various different diameter.

Figure 3:
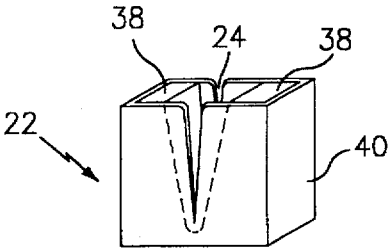
FIG. 3 shows an alternative embodiment of the structure of FIG. 1.

Referring now to FIG. 3, an alternative embodiment of notch structure 22 is illustrated. As shown, notch structure 22 may suitably be provided having nylon or other compressible or flexible wiper members 38 which advantageously deflect upon insertion of nail 18 into groove 24 so as to frictionally engage nails 18 of wide variety in diameter. Furthermore, in accordance with this embodiment of the invention, notch structure 22 may suitably be provided as a generally upwardly open sleeve structure 40 into which replaceable wipers 38 can be inserted and removed.

Figure 2A:
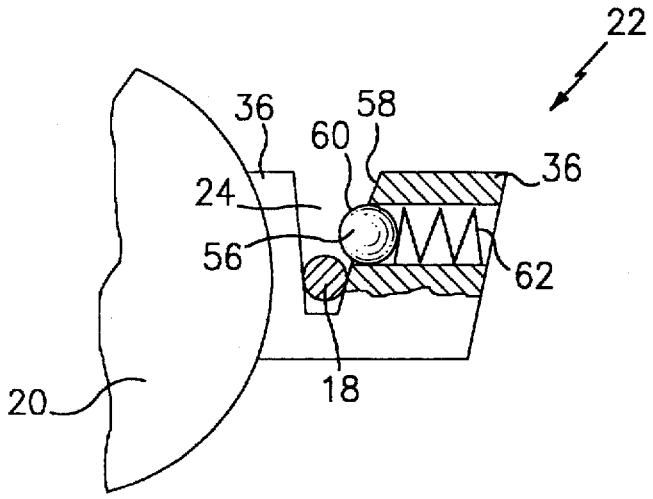
FIG. 2*a* is a partially sectional view of an alternative embodiment of a nail-holding structure.

According to still another embodiment, notch structure 22 may be provided having a detent member 56 (FIG. 2*a*) biased outwardly to extend beyond an inner surface 58 of one or both arms 36 and into notch 24. Detent member 56 preferably has an at least partially spherical profile at the extending portion 60 thereof, and may suitably be outwardly biased by a spring 62 or any other member so as to allow a nail 18 to be pushed into notch 24 past detent member 56 so as to be releasably but firmly held or engaged in place by detent member 56.

Referring back to FIG. 1, striking anvil portion 28 of nail-holding structure 16 preferably includes a substantially flat anvil surface 42 against which head 30 of nail 18 rests in an engaged position of nail 18 as shown in FIG. 1. In accordance with the invention, and advantageously, anvil surface 42 is provided having sufficient area to contact substantially the entire area of head 30 of nail 18 so as to provide a firm striking surface from which nails held within nail-holding structure 16 can be started or driven. In further accordance with the invention, anvil portion 28 also preferably further includes a projection member 44 extending laterally from anvil surface 42, preferably positioned at an upper portion of anvil surface 42 as shown, so as to prevent upward sliding of head 30 relative to anvil surface 42 when nail 18 is in the engaged position. Furthermore, striking anvil portion 28 may also preferably include a lip member 46 preferably downwardly extending from projection member 44, for example as shown in FIG. 1, so that head 30 of nail 18, when in the engaged position, has the striking portion 48 resting against anvil surface 42, and lip member 46 extends at least partially over the opposed portion 50 of head 30, thereby holding nail 18 within nail-holding structure 16 and against longitudinal movement of nail 18 along the axis thereof.

This structure advantageously allows for nails 18 to be readily positioned and engaged within nail-holding structure 16 for driving or starting in a material as desired, and further allows nail 18 to be readily released from this position through an ergonometric and natural movement of hammer 10 as will be further discussed and illustrated below.

Figure 4:
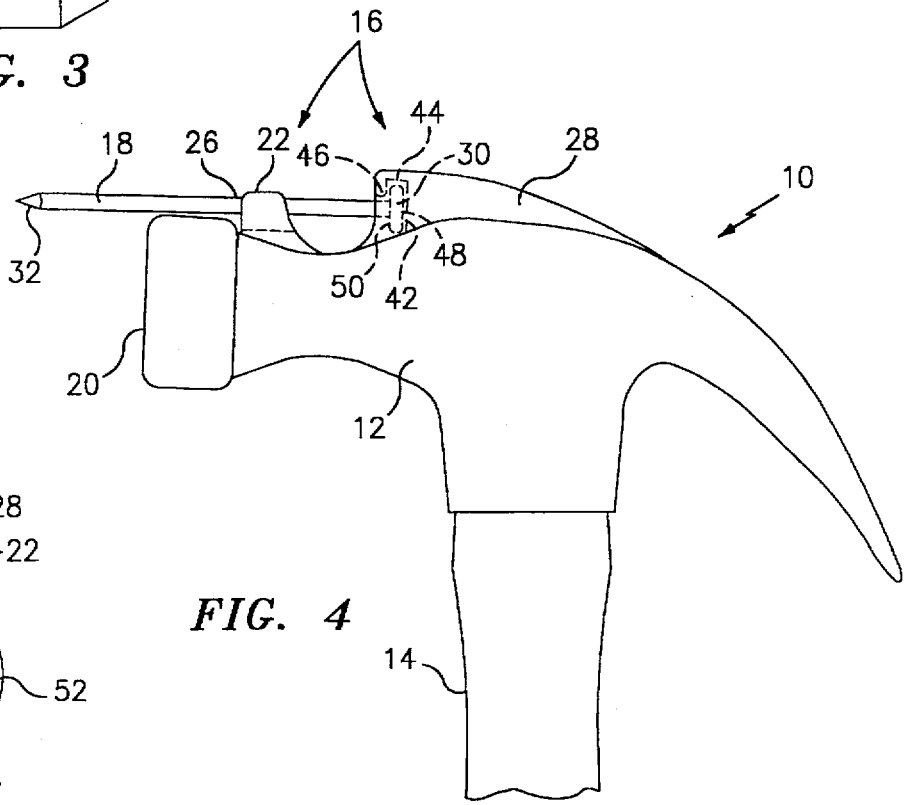
FIG. 4 shows an alternative embodiment of the present invention wherein the nail-holding structure is mounted to the top of the hammer head.

Still referring to FIG. 1, nail-holding structure 16 may suitably be positioned relative to hammer head 12 such that nail 18 extends in proximity to striking surface 20 of hammer head 12, but preferably without interfering with striking surface 20. As shown in FIG. 1, notch structure 22 and striking anvil portion 28 may suitably be positioned so as to hold a nail 18 along a side portion of hammer head 12, with nail 18 substantially vertically centered as shown. Referring to FIG. 4, notch structure 22 and striking anvil portion 28 may alternatively be positioned at a top region of hammer head 12 as shown, with nail 18 centered substantially laterally with respect to striking surface 20 of hammer head 12 (see FIG. 5). Alignment of nail 18 centered either vertically or laterally advantageously helps to allow a user of hammer 10 to start nails at a desired location.

Figure 5:
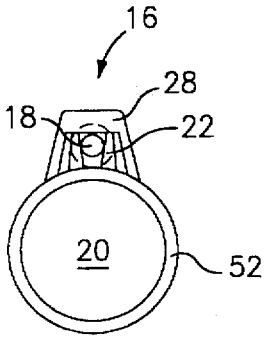
FIG. 5 is a front view of the embodiment of FIG. 4.

As shown in FIG. 5, placement of nail-holding structure 16 advantageously allows for holding nail 18 as desired for starting, without interfering with perimeter 52 of striking surface 20 of hammer head 12. Thus, after nail 18 has been started, a normal hammering action can be used without concern for striking nail 18 with an incomplete portion of striking surface 20. It should of course be noted that while FIG. 5 shows nail 18 held at a top portion of striking surface 20 and outside of perimeter 52, the embodiment of FIG. 1 would result in nail 18 being held to the side of striking surface 20 and outside of perimeter 52 in similar fashion.

Figure 6:
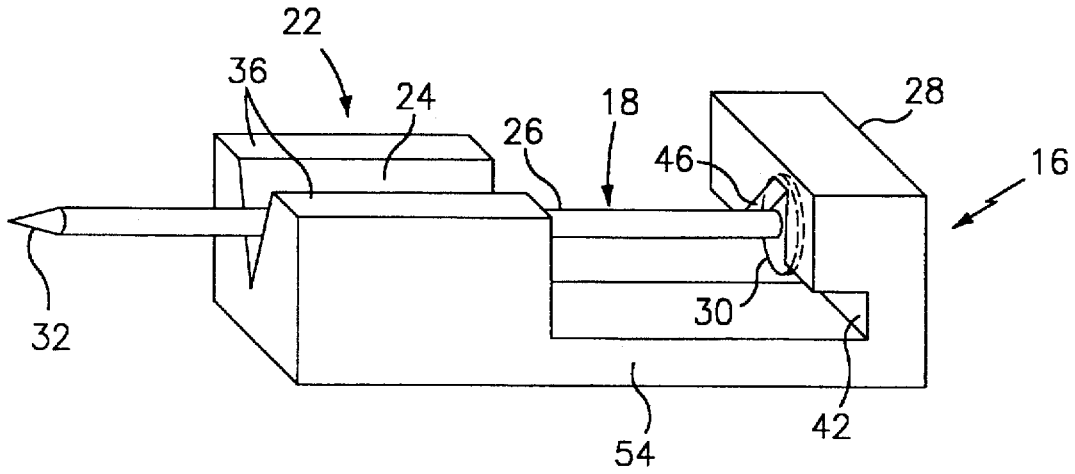
FIG. 6 further illustrates the structure of another portion of the nail-holding feature of the present invention.

Referring now to FIG. 6, the preferred structure of nail-holding structure 16 in accordance with the present invention will be further illustrated. As shown, structure 16 may suitably be provided having a body portion 54 connected between notch structure 22 and striking anvil portion 28. Body portion 54 serves advantageously to strengthen the structure and enhance the durability of striking anvil portion 28 so as resist bending or other damage due to repeated use. For example, as shown in FIG. 6, notch structure 22, body portion 54 and striking anvil portion 28 may suitably be provided as an integral member, and may further preferably be provided as an integral portion of hammer head 12, for example by casting, so as to provide a sturdy and reliable structure in accordance with the present invention.

Figure 7A:
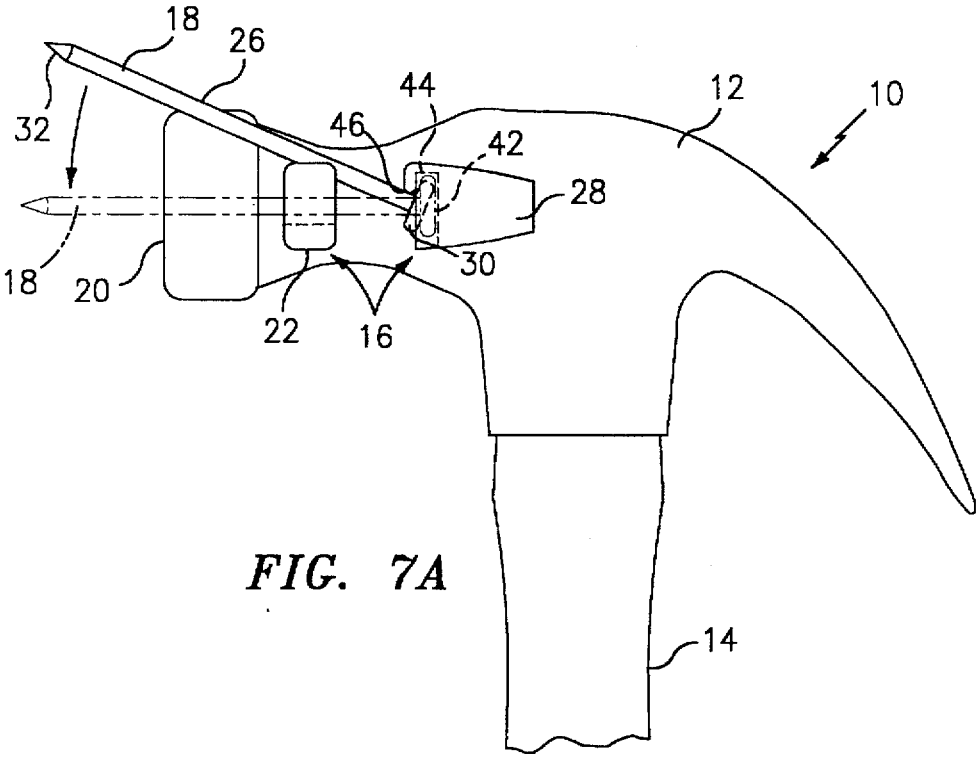
FIG. 7*a* illustrates the placement of a nail in a nail-holding attachment in accordance with the present invention.
Figure 7B:
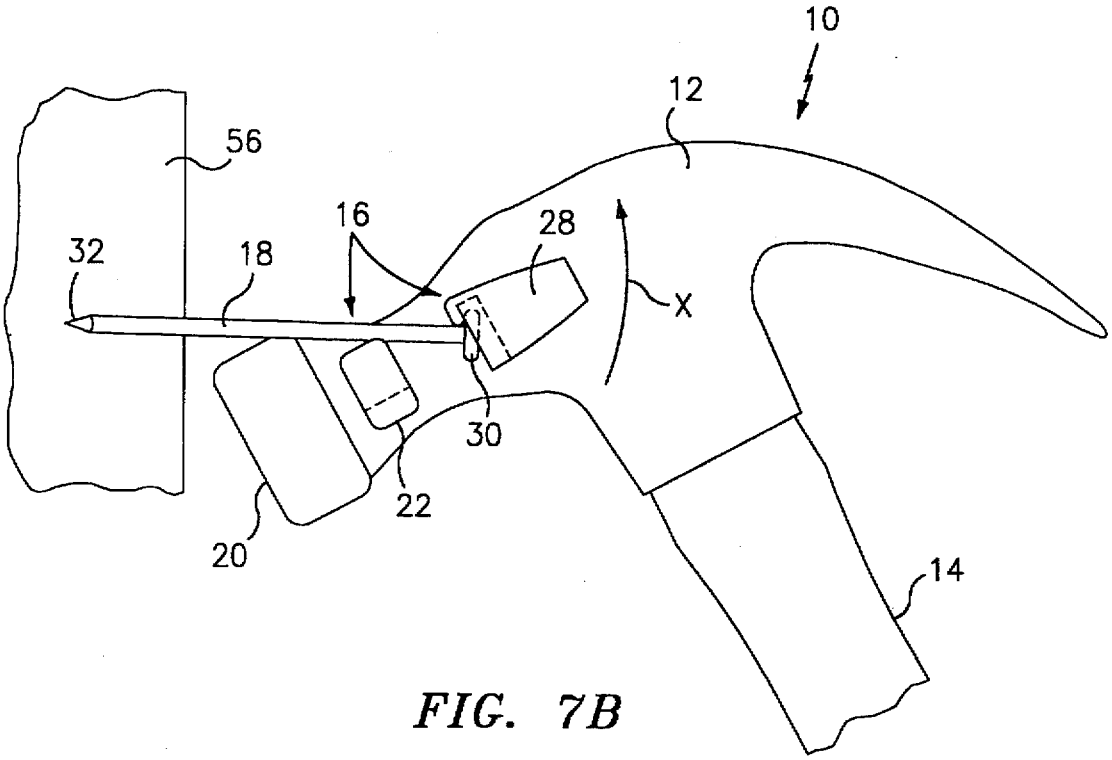
FIG. 7*b* illustrates disengagement of a nail from a nail-holding attachment of the present invention after the nail has been started.

Referring now to FIGS. 7*a* and 7*b*, the use of hammer 10 in accordance with the present invention is illustrated. As shown, a nail may suitably be positioned within nail-holding structure 16 by starting with the nail in position as shown by solid lines, and then downwardly pivoting a point 32 of nail 18 relative to head 30 so as to rest body portion 26 of nail 18 within groove 24 of notch structure 22 with head 30 of nail 18 engaged by striking anvil portion 28 in an engaged position as shown by dashed lines in FIG. 7*a*. In this position, and advantageously, nail 18 is firmly engaged or held within nail-holding structure 16 and will remain there during a conventional swing of hammer 10 so as to drive nail 18 into a suitable structure 56 (see FIG. 7*b*), as desired.

Referring to FIG. 7*b*, once nail 18 is started in structure 56, hammer 10 may suitably be pivoted in a natural motion as illustrated by arrow X so as to provide relative downward pivot of head 30 of nail 18 relative to point 32 of nail 18, thereby releasing head 30 from striking anvil portion 28 and preferably at least partially removing body portion 26 of nail 18 from notch structure 22. After such pivot, hammer 10 can readily be pulled back from nail 18, with nail 18 released, and hammer 10 can then be used to conventionally finish driving nail 18 into structure 56 as desired.

It should readily be recognized that hammer 10 in accordance with the present invention provides for holding a nail to start same, without interfering with striking surface 20 of hammer head 12, and without conventionally used magnets which de-magnetize, and further without including any moving parts and the like which are undesirable to conventional users and which increase the cost and potential for breaking of apparatus 10. Furthermore, nails are easily placed within structure 16 for holding of same, and are also readily released from structure 16 after being driven into structure 56 as desired in accordance with the invention.

Furthermore, the striking anvil portion 28 of structure 16 in accordance with the invention provides for a full surface to strike the head 30 of a nail 18 being started, and thereby substantially prevents the possibility of destruction or deformation of head 30 during starting of nail 18.

As set forth above, structure 16 is preferably casted or otherwise provided as an integral portion of hammer head 12 so as to provide structural strength. Alternatively, structure 16 could be fixed in any suitable matter to hammer head 12, so long as sufficient strength is provided to withstand repeated use of same.

It should also be noted that several portions of this description refer to top or upper areas or features of the invention, and that these features are to be considered with hammer 10 oriented as illustrated for example in FIG. 1.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A nail holding hammer, comprising:

a hammer head having a forward nail striking surface, said nail striking surface having a substantially uniform perimeter;

a hammer handle downwardly extending from said hammer head; and means for releasably holding a nail having a point, a head and a body portion therebetween, wherein said means for releasably holding holds said nail with said point facing forward, said means for holding comprising a notch for receiving said body portion and a striking anvil for contacting said head with said body portion in said notch wherein said means for releasably holding is positioned at a side of said hammer head, substantially vertically centered with respect to said striking surface, and wherein said means for releasably holding is further positioned relative to said striking surface to position said nail exterior of said perimeter.

2. A hammer according to claim 1, wherein said striking anvil comprises a substantially flat surface arranged to abut said head of said nail, and a projection member extending transversely from said striking anvil to prevent direct upward movement of said nail head in contact with said striking anvil.

3. A hammer according to claim 2, further comprising a lip member extending downwardly from said projection member for preventing longitudinal movement of said nail.

4. A hammer according to claim 3, wherein said nail head has a striking surface and an opposite surface, and wherein said lip member is arranged to extend at least partially over said opposite surface when said striking surface is positioned adjacent to said striking anvil.

5. A hammer according to claim 4, wherein said striking anvil has a substantially open portion arranged opposite to said projection whereby said nail head is free to pivot downwardly out of engagement with said projection member and said lip member.

6. A hammer according to claim 1, wherein said notch comprises a substantially V-shaped groove for accommodating nails having different diameters.

7. A hammer according to claim 1, further comprising a detent member movably positioned relative to said notch and biased toward an extending position extending into said notch for holding said nail in place in said notch.

8. A hammer according to claim 1, further comprising compressible means within said notch for frictionally engaging said body of said nail.

9. A hammer according to claim 8, wherein said means for frictionally engaging comprises a resilient wipe member replaceably mounted within said notch.

10. A hammer according to claim 1, wherein said means for releasably holding is an integral portion of said hammer head.

11. A hammer according to claim 1, wherein said means for releasably holding is free of magnets.

12. A hammer according to claim 1, further comprising a support member extending between said notch and said striking anvil for enhancing structural strength of said striking anvil.

13. A nail holding hammer, comprising:

a hammer head having a forward nail striking surface;

a hammer handle downwardly extending from said hammer head; and means for releasably holding a nail in an engaged position wherein said nail is engaged against longitudinal movement, wherein said means for releasably holding receives a nail in said engaged position through upward pivot of a head of said nail relative to a point of said nail, and said nail is released from said engaged position through downward pivot of said head relative to said point, wherein said means for releasably holding is positioned at a side of said hammer head, substantially vertically centered with respect to said striking surface.

14. A nail holding hammer, comprising:

a hammer head having a forward nail striking surface; and means for releasably holding a nail having a point, a head and a body portion therebetween, wherein said means for releasably holding holds said nail with said point facing forward, said means for holding comprising a notch for receiving said body portion and a striking anvil for contacting said head with said body portion in said notch;

wherein said striking anvil comprises a substantially flat surface arranged to abut said head of said nail, and a projection member extending transversely from said striking anvil to prevent direct upward movement of said nail head in contact with said striking anvil, and further comprising a lip member extending downwardly from said projection member for preventing longitudinal movement of said nail.

* * * * *